US011314192B2

(12) United States Patent
Inoue et al.

(10) Patent No.: US 11,314,192 B2
(45) Date of Patent: Apr. 26, 2022

(54) ELECTRICAL CONNECTOR, HEATER, FIXING DEVICE, AND IMAGE FORMING APPARATUS

(71) Applicant: Ricoh Company, Ltd., Tokyo (JP)

(72) Inventors: Daisuke Inoue, Tokyo (JP); Yuusuke Furuichi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/197,694

(22) Filed: Mar. 10, 2021

(65) Prior Publication Data

US 2021/0318655 A1 Oct. 14, 2021

(30) Foreign Application Priority Data

Apr. 9, 2020 (JP) ..... JP2020-070459

(51) Int. Cl.
*G03G 15/20* (2006.01)
*G03G 15/00* (2006.01)
*H05B 3/06* (2006.01)

(52) U.S. Cl.
CPC ..... *G03G 15/80* (2013.01); *G03G 15/2053* (2013.01); *H05B 3/06* (2013.01)

(58) Field of Classification Search
CPC ..... G03G 15/80; G03G 15/2053; H01R 4/00; H05B 3/06; H05B 3/26
See application file for complete search history.

(56) References Cited

U.S. PATENT DOCUMENTS

| | | | | |
|---|---|---|---|---|
| 4,662,702 | A | 5/1987 | Furuya | |
| 6,090,305 | A | 7/2000 | Balch et al. | |
| 9,125,241 | B2 * | 9/2015 | Aritaki | H05B 3/26 |
| 2013/0302060 | A1 * | 11/2013 | Moriya | G03G 15/80 399/90 |
| 2013/0336672 | A1 | 12/2013 | Mizuta et al. | |
| 2020/0033767 | A1 | 1/2020 | Adachi et al. | |
| 2020/0033771 | A1 | 1/2020 | Furuichi et al. | |
| 2020/0033774 | A1 * | 1/2020 | Shinji | G03G 15/2053 |

(Continued)

FOREIGN PATENT DOCUMENTS

| | | |
|---|---|---|
| EP | 0 585 857 A1 | 3/1994 |
| JP | 6-084584 | 3/1994 |

(Continued)

OTHER PUBLICATIONS

Extended European Search Report dated Aug. 26, 2021 in European Patent Application No. 21163070.2, 9 pages.

(Continued)

*Primary Examiner* — Sophia S Chen
(74) *Attorney, Agent, or Firm* — Xsensus LLP

(57) ABSTRACT

An electrical connector includes a power feeding portion and a powered portion that contacts the power feeding portion. At least one of the power feeding portion and the powered portion includes a surface layer, a primary coat layer, and an exposed portion. The surface layer is made of a first conductive metal and includes a contact portion where the power feeding portion contacts the powered portion. The primary coat layer mounts the surface layer and is made of a second conductive metal. The exposed portion is separated from the contact portion and exposed to an atmosphere.

14 Claims, 9 Drawing Sheets

(56) References Cited

U.S. PATENT DOCUMENTS

| | | | | |
|---|---|---|---|---|
| 2020/0033775 | A1 | 1/2020 | Inoue et al. | |
| 2020/0103796 | A1 | 4/2020 | Furuichi et al. | |
| 2020/0103797 | A1 | 4/2020 | Furuichi | |
| 2020/0103799 | A1 | 4/2020 | Adachi et al. | |
| 2020/0103803 | A1 | 4/2020 | Furuichi | |
| 2020/0103814 | A1* | 4/2020 | Someya | G03G 15/80 |
| 2020/0117124 | A1 | 4/2020 | Furuichi | |
| 2020/0117125 | A1 | 4/2020 | Furuichi | |
| 2020/0174407 | A1 | 6/2020 | Furuichi | |
| 2020/0174408 | A1 | 6/2020 | Furuichi et al. | |
| 2020/0183307 | A1 | 6/2020 | Furuichi et al. | |
| 2020/0249601 | A1 | 8/2020 | Inoue et al. | |
| 2020/0249604 | A1 | 8/2020 | Adachi et al. | |
| 2020/0292972 | A1 | 9/2020 | Inoue et al. | |
| 2020/0379384 | A1 | 12/2020 | Samei et al. | |
| 2020/0387096 | A1 | 12/2020 | Adachi et al. | |
| 2020/0401067 | A1 | 12/2020 | Samei et al. | |
| 2021/0041810 | A1 | 2/2021 | Furuichi | |
| 2021/0041832 | A1 | 2/2021 | Furuichi | |
| 2021/0181661 | A1* | 6/2021 | Seki | G03G 15/2053 |

FOREIGN PATENT DOCUMENTS

| | | |
|---|---|---|
| JP | 2000-113931 | 4/2000 |
| JP | 2011-018572 | 1/2011 |

OTHER PUBLICATIONS

U.S. Appl. No. 17/086,764, filed Nov. 2, 2020, Daisuke Inoue, et al.

* cited by examiner

ELECTRICAL CONNECTOR, HEATER, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2020-070459, filed on Apr. 9, 2020, in the Japan Patent Office, the entire disclosure of which is hereby incorporated by reference herein.

BACKGROUND

Technical Field

Exemplary aspects of the present disclosure relate to an electrical connector, a heater, a fixing device, and an image forming apparatus, and more particularly, to an electrical connector, a heater incorporating the electrical connector, a fixing device incorporating the heater, and an image forming apparatus incorporating the fixing device.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a fixing device incorporating a heater (e.g., a laminated heater) that is supplied with power through a connector. The connector includes a connector terminal that resiliently contacts an electrode as a counter component. While the image forming apparatus operates, a body of the image forming apparatus vibrates. Accordingly, a contact portion of the connector terminal may be slightly shifted from a contact portion of the electrode, that contacts the contact portion of the connector terminal, repeatedly. Consequently, the contact portions of the connector terminal and the electrode may suffer from abrasion gradually.

Since it is difficult to seal the contact portions, the contact portions are exposed to the atmosphere. Hence, oxygen and sulfur gas in the atmosphere corrode (e.g., oxidize and sulfurize) the contact portions. Since a corroded region of each of the contact portions has an increased electric resistance, when the connector terminal contacts the corroded region, the connector terminal may suffer from conduction failure due to the increased electric resistance.

SUMMARY

This specification describes below an improved electrical connector. In one embodiment, the electrical connector includes a power feeding portion and a powered portion that contacts the power feeding portion. At least one of the power feeding portion and the powered portion includes a surface layer, a primary coat layer, and an exposed portion. The surface layer is made of a first conductive metal and includes a contact portion where the power feeding portion contacts the powered portion. The primary coat layer mounts the surface layer and is made of a second conductive metal. The exposed portion is separated from the contact portion and exposed to an atmosphere.

This specification further describes an improved heater. In one embodiment, the heater includes the electrical connector described above and a resistor connected to the powered portion of the electrical connector. The resistor generates heat by energization.

This specification further describes an improved fixing device. In one embodiment, the fixing device includes a fixing rotator that rotates and the heater described above. The heater heats the fixing rotator.

This specification further describes an improved image forming apparatus. In one embodiment, the image forming apparatus includes the fixing device described above.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
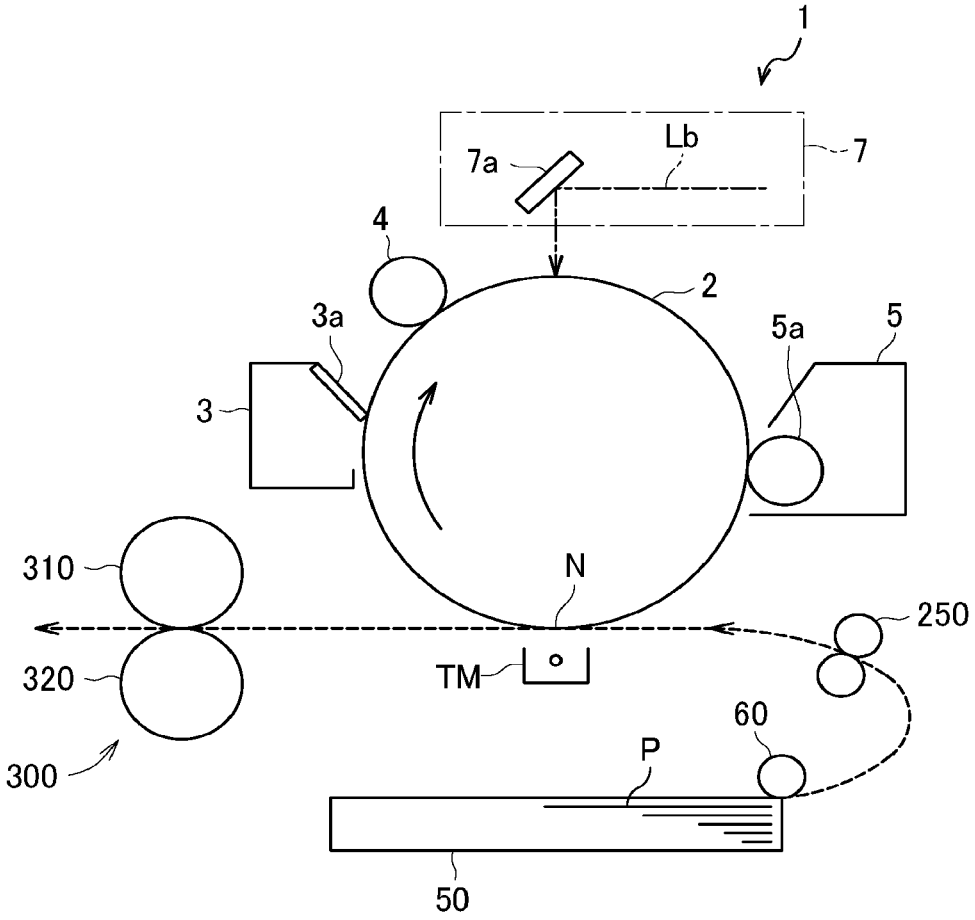
FIG. 1 is a schematic cross-sectional view of an image forming apparatus according to an embodiment of the present disclosure, illustrating a principle thereof.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring to drawings, a description is provided of a construction of a heater, a fixing device incorporating the heater, and an image forming apparatus (e.g., a laser printer) incorporating the fixing device according to embodiments of the present disclosure. A laser printer is one example of the image forming apparatus. The image forming apparatus is not limited to the laser printer. For example, the image forming apparatus may be a copier, a facsimile machine, a printer, a printing machine, an inkjet recording apparatus, or a multifunction peripheral (MFP) having at least two of copying, facsimile, printing, scanning, and inkjet recording functions.

In the drawings, identical reference numerals are assigned to identical elements and equivalents and redundant descriptions of the identical elements and the equivalents are summarized or omitted properly. The dimension, material, shape, relative position, and the like of each of the elements are examples and do not limit the scope of this disclosure unless otherwise specified.

According to the embodiments below, a sheet is used as a recording medium. However, the recording medium is not limited to paper as the sheet. In addition to paper as the sheet, the recording media include an overhead projector (OHP) transparency, cloth, a metal sheet, plastic film, and a prepreg sheet pre-impregnated with resin in carbon fiber.

The recording media also include a medium adhered with a developer and ink, recording paper, and a recording sheet. The sheets include, in addition to plain paper, thick paper, a postcard, an envelope, thin paper, coated paper, art paper, and tracing paper.

Image formation described below denotes forming an image having meaning such as characters and figures and an image not having meaning such as patterns on the medium.

A description is provided of a construction of an image forming apparatus 1.

FIG. 1 is a schematic cross-sectional view of the image forming apparatus 1 incorporating a fixing device 300 according to an embodiment of the present disclosure, illustrating a principle of the image forming apparatus 1. The image forming apparatus 1 includes an image bearer 2 (e.g., a photoconductive drum), a drum cleaner 3, a charger 4, a developing device 5, and a discharger. The charger 4 serves as a charging member or a charging device that uniformly charges a surface of the image bearer 2. The developing device 5 serves as a developing member that develops an electrostatic latent image formed on the image bearer 2 into a visible image.

An exposure device 7 disposed above the image bearer 2 performs scanning and writing according to image data. For example, the exposure device 7 includes a laser diode that emits a laser beam Lb according to the image data and a mirror 7*a* that reflects the laser beam Lb to the image bearer 2 so that the laser beam Lb irradiates the image bearer 2. The developing device 5 supplies toner as a developer to the electrostatic latent image formed on the image bearer 2 irradiated with the laser beam Lb, thus forming a toner image on the image bearer 2.

A registration roller pair 250 serving as a conveyer temporarily halts a sheet P serving as a recording medium fed by a sheet feeding roller 60 from a sheet tray 50. As the registration roller pair 250 temporarily halts the sheet P, the registration roller pair 250 slacks a leading end of the sheet P, correcting skew of the sheet P.

After the leading end of the sheet P strikes the registration roller pair 250 and slacks, the registration roller pair 250 conveys the sheet P to a transfer nip N at a proper time when the toner image formed on the image bearer 2 is transferred onto the sheet P. A transfer device TM is disposed below the image bearer 2. A bias applied at the transfer nip N transfers the toner image formed on the image bearer 2 onto the sheet P conveyed to the transfer nip N.

The fixing device 300 includes a fixing belt 310 and a pressure roller 320. The fixing belt 310 accommodates a heater. The pressure roller 320 serves as a pressure rotator or a pressure member that rotates while the pressure roller 320 contacts the fixing belt 310 with predetermined pressure. The fixing device 300 has a construction illustrated in FIG. 2A. Alternatively, the fixing device 300 may be replaced by fixing devices 300S, 300T, and 300U that have constructions described below with reference to FIGS. 2B, 2C, and 2D, respectively.

A description is provided of basic operations of the image forming apparatus 1.

The sheet feeding roller 60 rotates according to a sheet feeding signal sent from a controller of the image forming apparatus 1. The sheet feeding roller 60 separates an uppermost sheet P from other sheets P of a sheaf of sheets P loaded in the sheet tray 50 and feeds the uppermost sheet P to a sheet feeding path downstream in a sheet conveyance direction.

When the leading end of the sheet P sent by the sheet feeding roller 60 reaches a nip of the registration roller pair 250, the registration roller pair 250 slacks and halts the sheet P temporarily. The registration roller pair 250 conveys the sheet P to the transfer nip N at an optimal time in synchronism with a time when the transfer device TM transfers the toner image formed on the image bearer 2 onto the sheet P while the registration roller pair 250 corrects skew of the leading end of the sheet P.

The charger 4 uniformly charges the surface of the image bearer 2 at a high electric potential. The exposure device 7 emits a laser beam Lb that irradiates the surface of the image bearer 2 according to image data.

The electric potential of an irradiated portion on the surface of the image bearer 2, which is irradiated with the laser beam Lb, decreases, forming an electrostatic latent image on the image bearer 2. The developing device 5 includes a developer bearer 5*a* that bears a developer containing toner. The developing device 5 transfers fresh toner onto a portion on the surface of the image bearer 2, which bears the electrostatic latent image, through the developer bearer 5*a*.

The surface of the image bearer 2 transferred with the toner bears a toner image developed with the toner. The transfer device TM transfers the toner image formed on the image bearer 2 onto the sheet P conveyed through the transfer nip N.

A cleaning blade 3*a* of the drum cleaner 3 removes residual toner failed to be transferred onto the sheet P and therefore adhered on the surface of the image bearer 2 therefrom. The removed residual toner is conveyed by a waste toner conveyer and collected into a waste toner container. The discharger removes residual electric charge from the image bearer 2 from which the drum cleaner 3 has removed the residual toner.

The sheet P transferred with the toner image is conveyed to the fixing device 300. The fixing belt 310 and the pressure roller 320 sandwich the sheet P conveyed to the fixing device 300 and fix the unfixed toner image on the sheet P under heat and pressure. The sheet P bearing the fixed toner image is conveyed from the fixing device 300 to a post-fixing conveyance path.

A description is provided of constructions of the fixing devices 300, 300S, 300T, and 300U according to a first embodiment, a second embodiment, a third embodiment, and a fourth embodiment of the present disclosure, respectively.

Figure 2A:
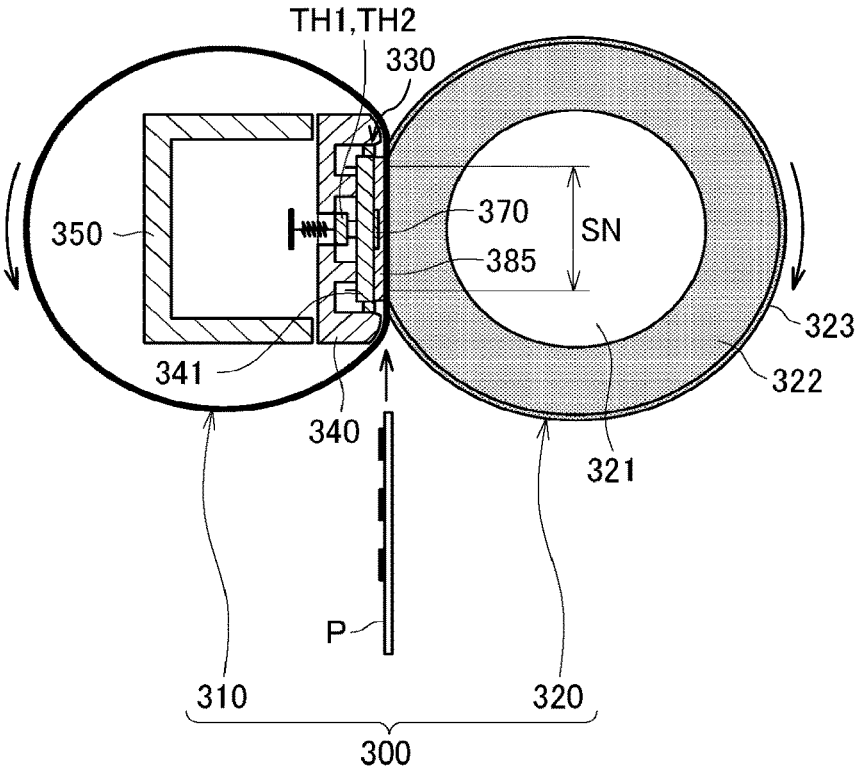
FIG. 2A is a cross-sectional view of a fixing device according to a first embodiment of the present disclosure, which is incorporated in the image forming apparatus depicted in FIG. 1.

As illustrated in FIG. 2A, the fixing device 300 according to the first embodiment includes the fixing belt 310 that is thin and has a decreased thermal capacity and the pressure roller 320.

A detailed description is now given of a construction of the fixing belt 310.

The fixing belt 310 includes a tubular base that is made of polyimide (PI) and has an outer diameter of 25 mm and a thickness in a range of from 40 μm to 120 μm, for example.

The fixing belt 310 further includes a release layer serving as an outermost surface layer. The release layer is made of fluororesin, such as tetrafluoroethylene-perfluoroalkylvinylether copolymer (PFA) and polytetrafluoroethylene (PTFE), and has a thickness in a range of from 5 μm to 50 μm to enhance durability of the fixing belt 310 and facilitate separation of the sheet P and a foreign substance from the fixing belt 310. Optionally, an elastic layer that is made of rubber or the like and has a thickness in a range of from 50 μm to 500 μm may be interposed between the base and the release layer.

The base of the fixing belt 310 may be made of heat resistant resin such as polyetheretherketone (PEEK) or metal such as nickel (Ni) and stainless used steel (SUS), instead of polyimide. An inner circumferential surface of the fixing belt 310 may be coated with polyimide, PTFE, or the like to produce a slide layer.

A detailed description is now given of a construction of the pressure roller 320.

The pressure roller 320 has an outer diameter of 25 mm, for example. The pressure roller 320 includes a cored bar 321, an elastic layer 322, and a release layer 323. The cored bar 321 is solid and made of metal such as iron. The elastic layer 322 coats the cored bar 321. The release layer 323 coats an outer surface of the elastic layer 322. The elastic layer 322 is made of silicone rubber and has a thickness of 3.5 mm, for example.

In order to facilitate separation of the sheet P and the foreign substance from the pressure roller 320, the release layer 323 that is made of fluororesin and has a thickness of about 40 μm, for example, is preferably disposed on the outer surface of the elastic layer 322. A biasing member presses the pressure roller 320 against the fixing belt 310.

A stay 350 and a heater holder 340 are disposed inside a loop formed by the fixing belt 310 and extended in an axial direction of the fixing belt 310. The stay 350 includes a channel made of metal. Both lateral ends of the stay 350 in a longitudinal direction thereof are supported by side plates of the fixing device 300, respectively. The stay 350 receives pressure from the pressure roller 320 precisely to form a fixing nip SN between the fixing belt 310 and the pressure roller 320 stably.

The heater holder 340 holds a base 341 of a laminated heater 330 and is supported by the stay 350. The heater holder 340 is preferably made of heat resistant resin having a decreased thermal conductivity, such as liquid crystal polymer (LCP). Accordingly, the heater holder 340 reduces conduction of heat thereto, improving heating of the fixing belt 310.

In order to prevent contact with a high temperature portion of the base 341, the heater holder 340 has a shape that supports the base 341 at two positions in proximity to both ends of the base 341, respectively, in a short direction thereof. Accordingly, the heater holder 340 reduces conduction of heat thereto further, improving heating of the fixing belt 310.

A detailed description is now given of a construction of the laminated heater 330.

The laminated heater 330, serving as a heater, includes resistors 370 that include resistive heat generators, respectively. The resistors 370 are mounted on the base 341. The base 341 includes an elongate, thin metal plate and an insulator that coats the metal plate.

The base 341 is preferably made of aluminum, stainless steel, or the like that is available at reduced costs. Alternatively, instead of metal, the base 341 may be made of ceramic such as alumina and aluminum nitride or a nonmetallic material that has an increased heat resistance and an increased insulation such as glass and mica.

In order to improve evenness of heat conduction of the laminated heater 330 so as to enhance quality of an image formed on a sheet P, the base 341 may be made of a material that has an increased thermal conductivity such as copper, graphite, and graphene. According to this embodiment, the base 341 is made of alumina and has a short width of 8 mm, a longitudinal length of 270 mm, and a thickness of 1.0 mm.

A thermistor TH1 serving as a first temperature detector is disposed opposite a back face of the base 341, that is opposite a front face disposed opposite the fixing nip SN, in a minimum conveyance span in which a sheet P having a minimum width is conveyed. The thermistor TH1 detects the temperature of the fixing belt 310 in the minimum conveyance span where sheets P having a plurality of widths, respectively, are conveyed. The controller controls the temperature of the resistors 370 based on a temperature of the resistor 370 or the base 341, that is detected by the thermistor TH1.

A thermistor TH2 serving as a second temperature detector is disposed opposite the back face of the base 341 at a position that is outboard from the minimum conveyance span in a longitudinal direction of the base 341 and is in proximity to a lateral end of a sheet P having a minimum width of a plurality of widths of sheets P. The widths of the sheets P are greater than a length of the resistor 370 in a longitudinal direction thereof. The controller controls the temperature of the resistor 370 based on a temperature of the resistor 370 or the base 341, that is detected by the thermistor TH2, so as to suppress overheating of both lateral ends of the fixing belt 310 in the axial direction thereof.

A description is provided of the constructions of the fixing devices 300S, 300T, and 300U according to the second embodiment, the third embodiment, and the fourth embodiment of the present disclosure, respectively.

The fixing device 300 according to the first embodiment depicted in FIG. 2A provides variations thereof.

Figure 2B:
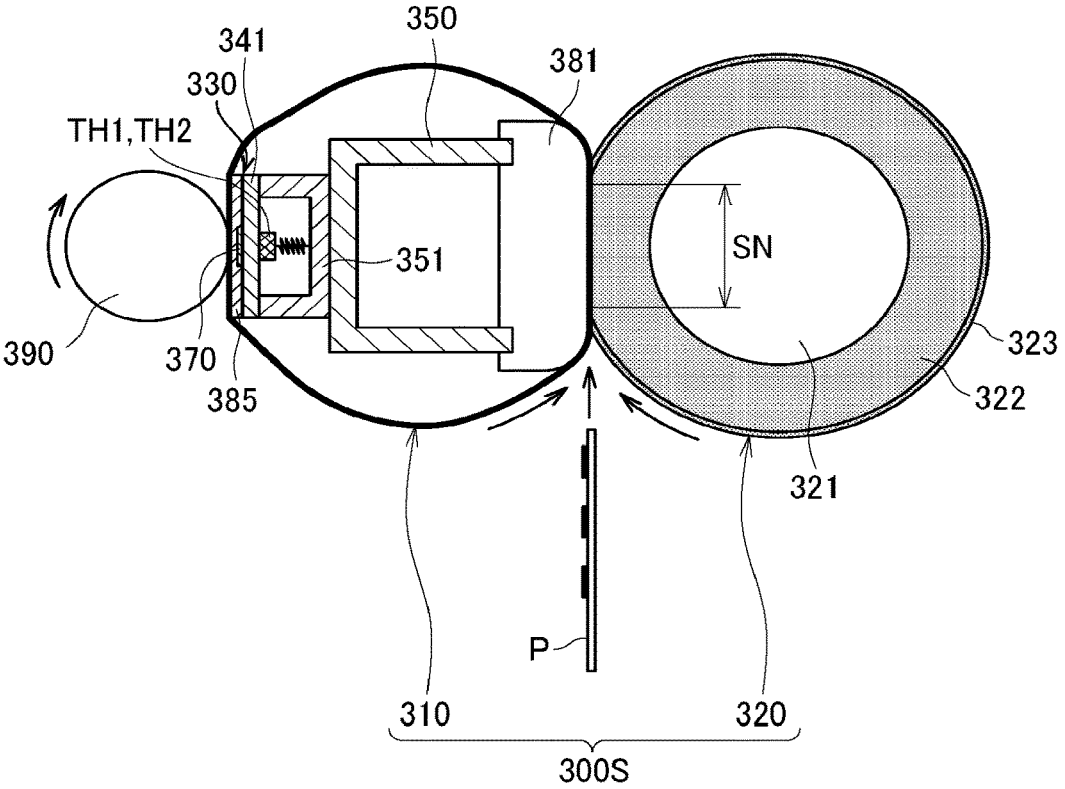
FIG. 2B is a cross-sectional view of a fixing device according to a second embodiment of the present disclosure, which is installable in the image forming apparatus depicted in FIG. 1.
Figure 2C:
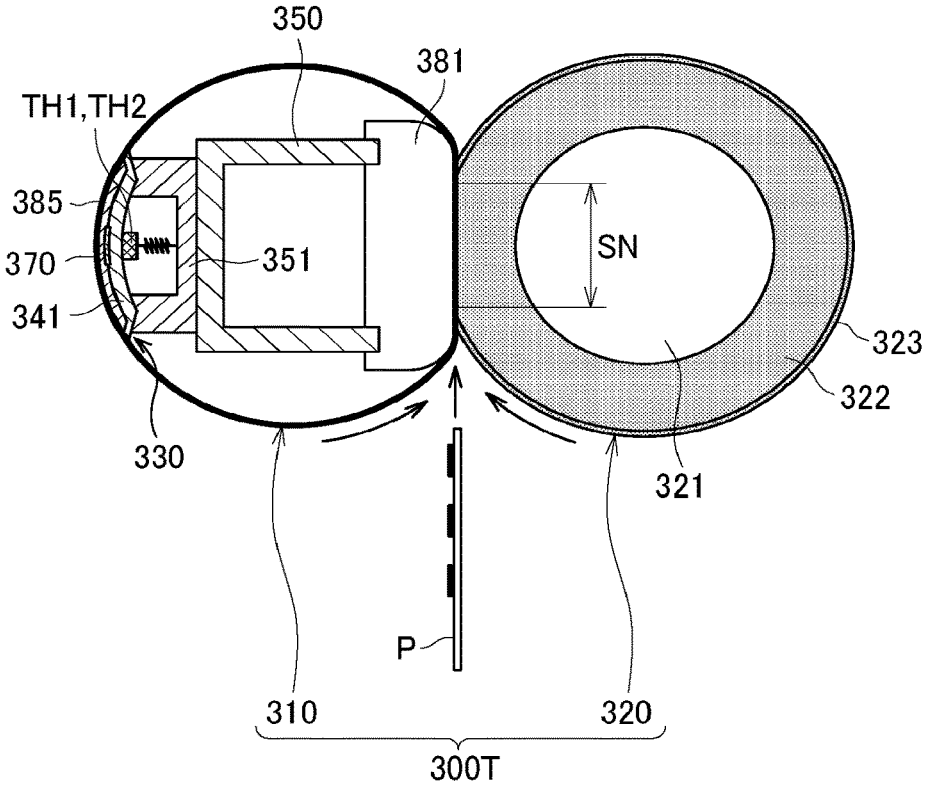
FIG. 2C is a cross-sectional view of a fixing device according to a third embodiment of the present disclosure, which is installable in the image forming apparatus depicted in FIG. 1.
Figure 2D:
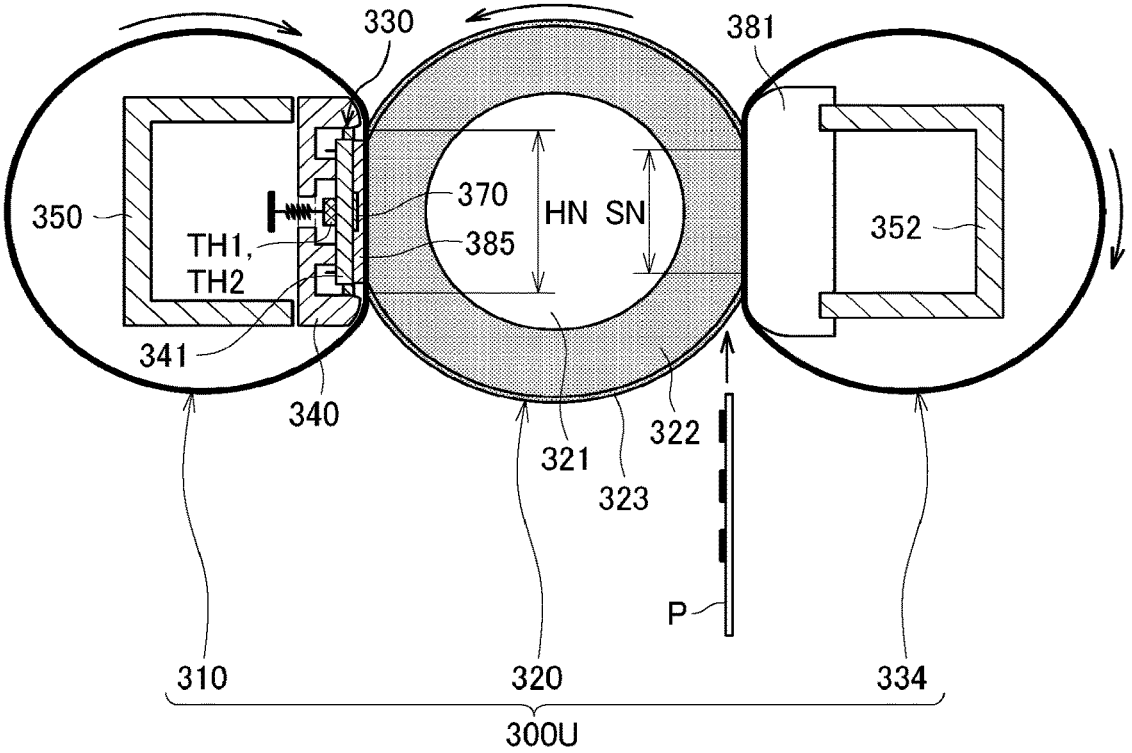
FIG. 2D is a cross-sectional view of a fixing device according to a fourth embodiment of the present disclosure, which is installable in the image forming apparatus depicted in FIG. 1.

Referring to FIGS. 2B, 2C, and 2D, the following describes the constructions of the fixing devices 300S, 300T, and 300U according to the second embodiment, the third embodiment, and the fourth embodiment, respectively.

As illustrated in FIG. 2B, the fixing device 300S according to the second embodiment includes a pressing roller 390 disposed opposite the pressure roller 320 via the fixing belt 310. The pressing roller 390 and the laminated heater 330 sandwich the fixing belt 310 such that the laminated heater 330 heats the fixing belt 310.

The laminated heater 330 is disposed inside the loop formed by the fixing belt 310. A supplementary stay 351 is mounted on a first side of the stay 350. A nip forming pad 381 serving as a nip former is mounted on a second side of the stay 350, which is opposite the first side thereof. The laminated heater 330 is supported by the supplementary stay 351. The pressure roller 320 is pressed against the nip forming pad 381 via the fixing belt 310 to form the fixing nip SN between the fixing belt 310 and the pressure roller 320.

As illustrated in FIG. 2C, the fixing device 300T according to the third embodiment includes the laminated heater 330 disposed inside the loop formed by the fixing belt 310. Since the fixing device 300T eliminates the pressing roller 390 described above with reference to FIG. 2B, in order to increase the length for which the laminated heater 330 contacts the fixing belt 310 in a circumferential direction thereof, the base 341 and an insulating layer 385 of the laminated heater 330 are curved into an arc in cross section that corresponds to a curvature of the fixing belt 310. The resistors 370 are disposed at a center of the base 341, that is arc-shaped, in the circumferential direction of the fixing belt 310. Except for elimination of the pressing roller 390 and the shape of the laminated heater 330, the fixing device 300T according to the third embodiment is equivalent to the fixing device 300S according to the second embodiment depicted in FIG. 2B.

As illustrated in FIG. 2D, the fixing device 300U according to the fourth embodiment defines a heating nip HN separately from the fixing nip SN. For example, the nip forming pad 381 and a stay 352 that includes a channel made of metal are disposed opposite the fixing belt 310 via the pressure roller 320. A pressure belt 334 that is rotatable accommodates the nip forming pad 381 and the stay 352. As a sheet P bearing a toner image is conveyed through the fixing nip SN formed between the pressure belt 334 and the pressure roller 320, the pressure belt 334 and the pressure roller 320 heat and fix the toner image on the sheet P. Except for the pressure belt 334 accommodating the nip forming pad 381 and the stay 352, the fixing device 300U according to the fourth embodiment is equivalent to the fixing device 300 according to the first embodiment depicted in FIG. 2A.

A description is provided of a construction of the laminated heater 330 incorporated in the fixing device 300.

Figure 3A:
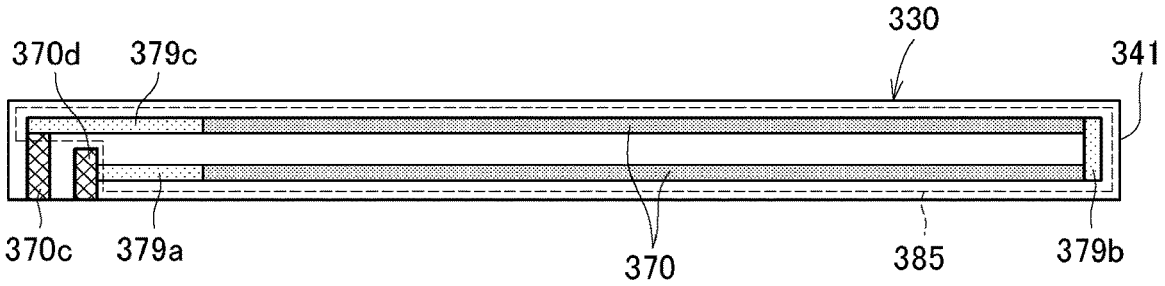
FIG. 3A is a plan view of a heater incorporated in the fixing device depicted in FIG. 2A.
Figure 3B:
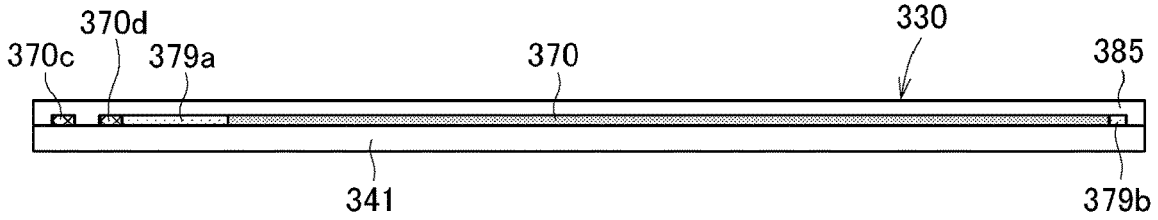
FIG. 3B is a cross-sectional view of the heater depicted in FIG. 3A.

FIGS. 3A and 3B illustrate the laminated heater 330 installed in the fixing device 300. The laminated heater 330 is a single heater (SH). The laminated heater 330 includes two resistors 370 that are straight. The resistors 370 are mounted on the base 341 and extended in the longitudinal direction of the base 341. The resistors 370 are connected in series and define two lines that are parallel to each other. One lateral end of one of the resistors 370 arranged in two lines is connected to an electrode 370*c* through a feeder 379*c*. One lateral end of another one of the resistors 370 is connected to an electrode 370*d* through a feeder 379*a*. The feeders 379*a* and 379*c*, having a decreased resistance value, are disposed on one lateral end of the base 341 and extended in the longitudinal direction of the base 341. Each of the electrodes 370*c* and 370*d* serves as a powered portion.

The electrodes 370*c* and 370*d* are connected to a power supply including an alternating current power supply disposed in a body of the image forming apparatus 1 through an electrical connector 400 described below with reference to FIG. 4A. The power supply includes a controller (e.g., a microcomputer) including a central processing unit (CPU), a read-only memory (ROM), a random access memory (RAM), and an input-output (I/O) interface. The power supply controls the temperature of the fixing belt 310 to a desired temperature based on temperatures of the fixing belt 310, that are detected by the thermistors TH1 and TH2, respectively. When a sheet P is conveyed through the fixing device 300, for example, the power supply supplies supplemental power properly by considering an amount of heat drawn to the sheet P in addition to the temperatures sent from the thermistors TH1 and TH2, respectively, thus adjusting the temperature of the fixing belt 310 properly.

Another lateral end of one of the resistors 370 is connected to another lateral end of another one of the resistors 370 through a feeder 379*b* such that one of the resistors 370, that extends in the longitudinal direction of the base 341 and in a direction directed to the feeder 379*b*, is turned at the feeder 379*b* and another one of the resistors 370 extends in the longitudinal direction of the base 341 and in an opposite direction. The feeder 379*b*, having a decreased resistance value, is disposed on another lateral end of the base 341 in the longitudinal direction thereof and extended in the short direction of the base 341. Each of the resistors 370, the electrodes 370*c* and 370*d*, and the feeders 379*a*, 379*b*, and 379*c* is produced by screen printing to have a predetermined line width and a predetermined thickness.

The resistors 370 are produced as below. Silver (Ag) or silver-palladium (AgPd) and glass powder and the like are mixed into paste. The paste coats the base 341 by screen printing or the like. Thereafter, the base 341 is subject to firing. For example, each of the resistors 370 has a resistance value of 10Ω at an ambient temperature. Alternatively, the resistors 370 may be made of a resistive material such as a silver alloy (AgPt) and ruthenium oxide ($RuO_2$).

A thin overcoat layer or the insulating layer 385 covers a surface of each of the resistors 370 and the feeders 379*a*, 379*b*, and 379*c*. The insulating layer 385 attains insulation between the fixing belt 310 and the resistors 370 and between the fixing belt 310 and the feeders 379*a*, 379*b*, and 379*c* while facilitating sliding of the fixing belt 310 over the insulating layer 385.

For example, the insulating layer 385 is made of heat resistant glass and has a thickness of 75 μm. The resistors 370 heat the fixing belt 310 that contacts the insulating layer 385 disposed above the resistors 370 in FIG. 3B by conduction of heat, increasing the temperature of the fixing belt 310 so that the fixing belt 310 heats and fixes the unfixed toner image on the sheet P conveyed through the fixing nip SN.

A description is provided of a construction of the electrical connector 400.

Figure 4A:
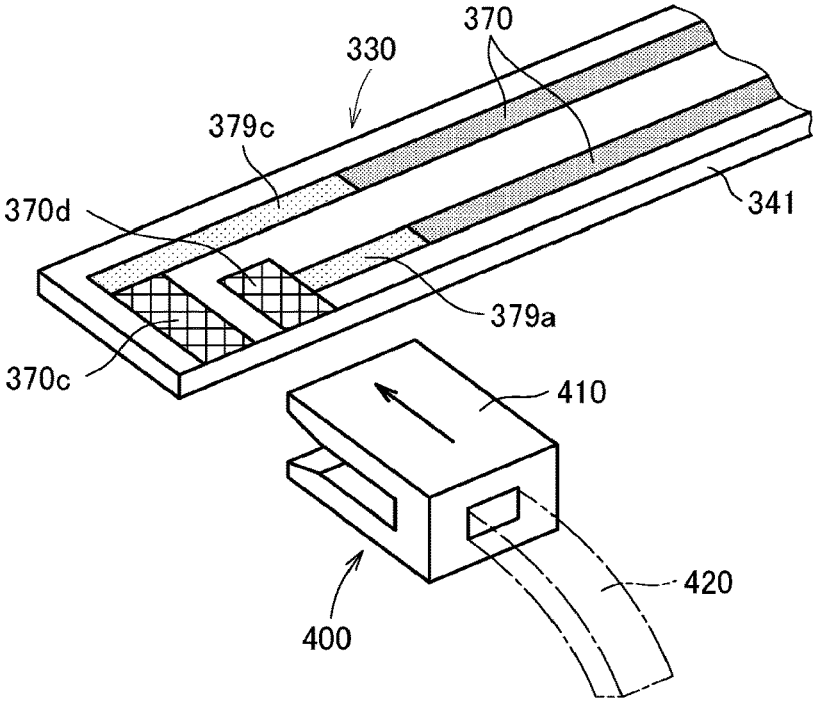
FIG. 4A is a perspective view of the heater depicted in FIG. 3A, illustrating an electrical connector incorporated therein.

As illustrated in FIG. 4A, the electrical connector 400 includes a connector portion that is coupled to the electrodes 370*c* and 370*d* serving as the powered portions such that the connector portion of the electrical connector 400 is attached to and removed from the electrodes 370*c* and 370*d* horizontally. The connector portion of the electrical connector 400 includes a housing 410 and a harness 420. The housing 410 is made of heat resistant resin and is U-shaped in cross section. The harness 420 is inserted into a rear end of the housing 410.

Figure 4B:
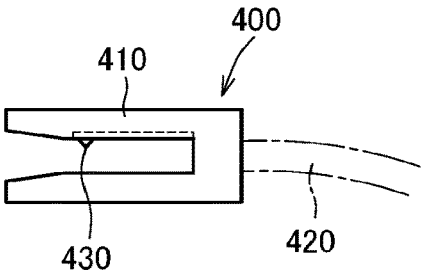
FIG. 4B is a side view of the electrical connector depicted in FIG. 4A, illustrating a connector terminal incorporated therein.

As illustrated in FIG. 4B, wire of the harness 420 is coupled to a pair of connector terminals 430 serving as a power feeding portion disposed on an inner face of the housing 410. As the connector terminals 430 resiliently contact the electrodes 370*c* and 370*d*, respectively, the connector terminals 430 are electrically connected to the electrodes 370*c* and 370*d*.

Figure 4C:
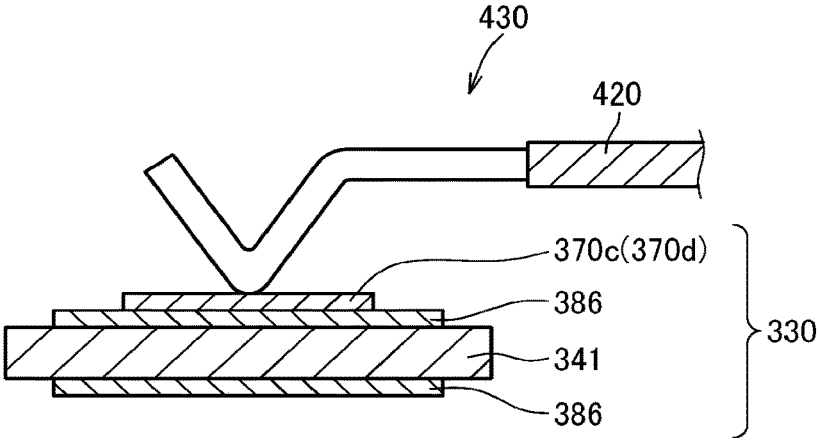
FIG. 4C is an enlarged cross-sectional view of the connector terminal depicted in FIG. 4B.

As illustrated in FIG. 4C, each of the connector terminals 430 includes a tip portion and a base portion. The tip portion is bent into a V-shape. The base portion is coupled to the harness 420. The tip portion includes a bent portion that is V-shaped and serves as a contact portion that contacts the electrode 370*c* or 370*d*.

The laminated heater 330 includes the base 341 and insulating layers 386. The base 341 is made of SUS. The insulating layers 386 are mounted on the front face and the back face of the base 341, respectively, and made of glass. The electrodes 370*c* and 370*d* are mounted on the insulating layer 386 mounted on the front face of the base 341. The V-shaped, bent portions of the connector terminals 430 resiliently contact the electrodes 370*c* and 370*d*, respectively. Power is supplied to the electrodes 370*c* and 370*d* through the V-shaped, bent portions, that is, the contact portions, of the connector terminals 430, respectively.

A description is provided of a construction of the connector terminal 430 according to a first embodiment of the present disclosure.

Figure 5B:
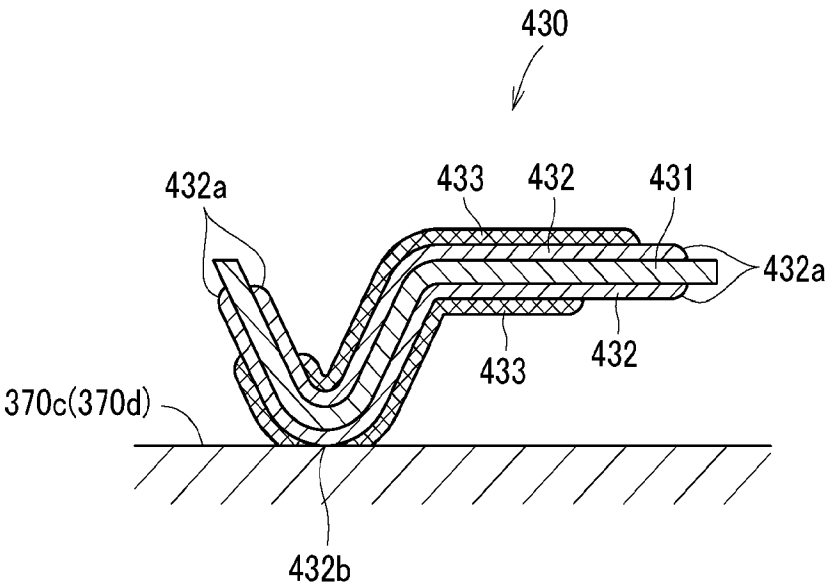
FIG. 5B is a cross-sectional view of the connector terminal depicted in FIG. 5A after the connector terminal suffers from abrasion.
Figure 5A:
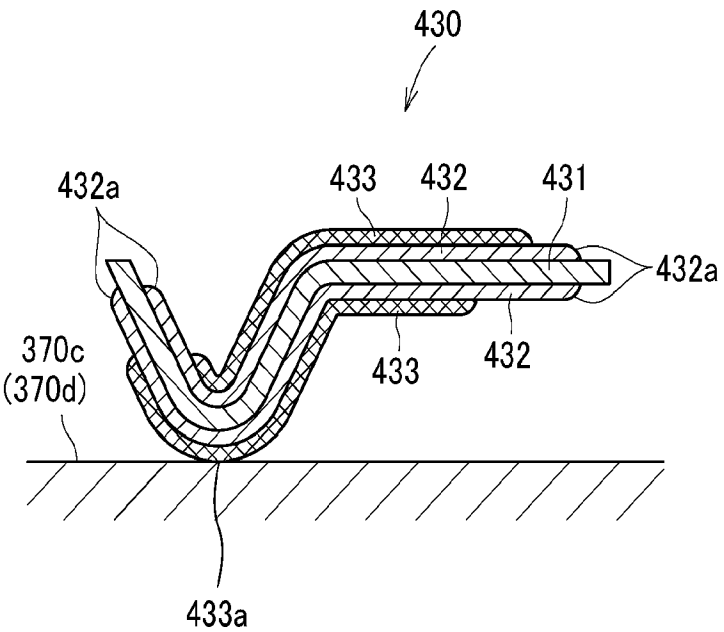
FIG. 5A is a cross-sectional view of the connector terminal depicted in FIG. 4C according to a first embodiment of the present disclosure before the connector terminal suffers from abrasion.

FIGS. 5A and 5B illustrate a cross section of the connector terminal 430 according to the first embodiment of the present disclosure, that is incorporated in the electrical connector 400. The connector terminal 430 serving as a power feeding portion includes a base layer 431 made of copper, a primary coat layer 432 treated with nickel plating, and a surface layer 433 treated with silver plating. As illustrated in FIG. 5A, the connector terminal 430 contacts the electrode 370*c* or 370*d* at a contact portion 433*a* before the connector terminal 430 suffers from abrasion. As illustrated in FIG. 5B, the connector terminal 430 contacts the electrode 370*c* or 370*d* at a contact portion 432*b* after the connector terminal 430 suffers from abrasion.

A description is provided of a construction of a comparative connector terminal.

The comparative connector terminal generally has a surface plated with a plurality of metal materials to improve corrosion resistance and electric conductivity. The comparative connector terminal incorporated in a comparative electrical connector includes a copper base plated with silver or nickel. A contact portion of an electrode is made of an alloy of silver and platinum. A portion of the electrode, that is other than the contact portion, is made of an alloy of silver and palladium. If the comparative connector terminal is used in a single heater (SH), the copper base generally mounts a nickel plating layer that mounts a silver plating layer.

With the comparative connector terminal including the copper base, the nickel plating layer, and the silver plating layer, as a body of a machine incorporating the comparative connector terminal vibrates and generates friction in the comparative connector terminal, the silver plating layer serving as a surface layer may peel off, exposing the nickel plating layer serving as a primary coat layer. Since the surface layer and the primary coat layer are made of different metal materials, respectively, the surface layer and the primary coat layer may suffer from corrosion by different gases, respectively. Hence, different corrosion inhibitors corresponding to the different metal materials, respectively, may be needed to suppress corrosion of the contact portion, increasing manufacturing costs and the size of the comparative connector terminal.

A description is provided of a construction of a connector terminal 430C as another comparative connector terminal.

Figure 6B:
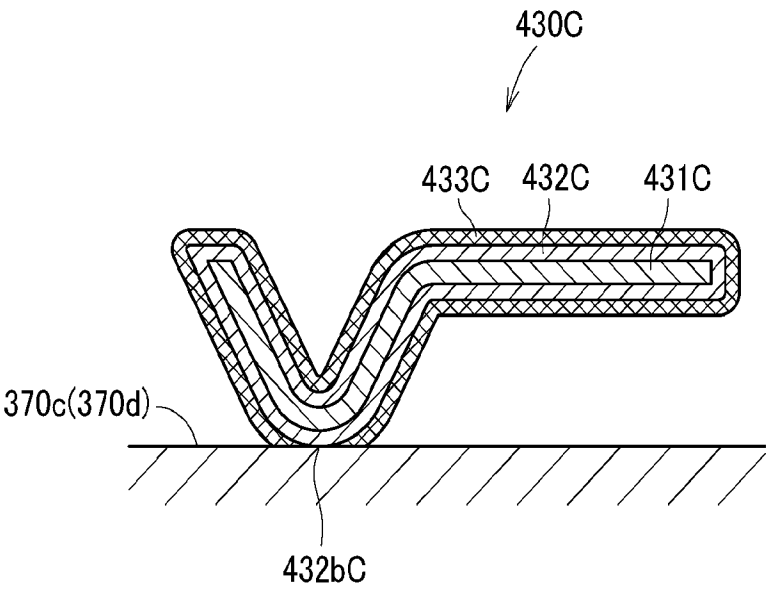
RELATED ART FIG. 6B
FIG. 6B is a cross-sectional view of the comparative connector terminal depicted in FIG. 6A after the comparative connector terminal suffers from abrasion.
Figure 6A:
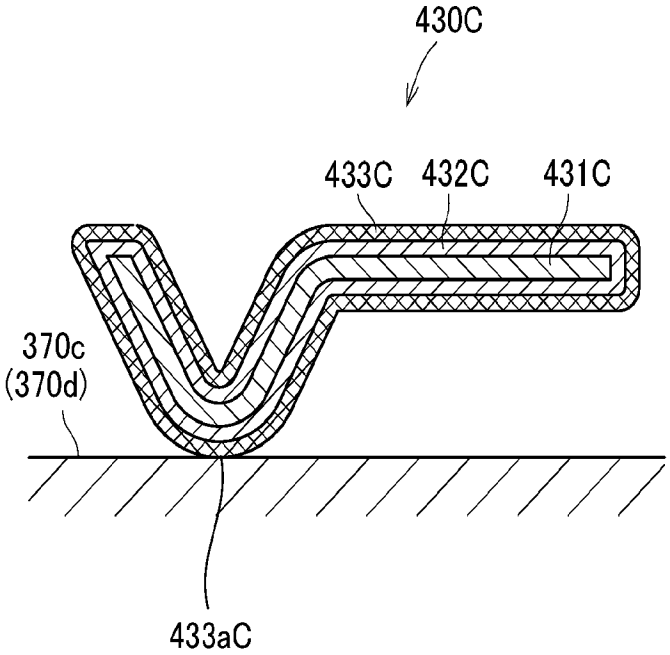
RELATED ART FIG. 6A
FIG. 6A is a cross-sectional view of a comparative connector terminal before the comparative connector terminal suffers from abrasion.

As illustrated in FIG. 6A, the connector terminal 430C includes a base layer 431C, a primary coat layer 432C, and a surface layer 433C. The primary coat layer 432C coats an entire surface of the base layer 431C. The surface layer 433C coats an entire surface of the primary coat layer 432C. Since the surface layer 433C coats the entire surface of the primary coat layer 432C, as a connector portion of an electrical connector incorporating the connector terminals 430C is attached to and removed from the electrodes 370*c* and 370*d* like the electrical connector 400 described above with reference to FIGS. 4A, 4B, and 4C, a contact portion 433*a*C of the surface layer 433C of the connector terminal 430C, that contacts the electrode 370*c* or 370*d*, may suffer from abrasion, exposing the primary coat layer 432C as illustrated in FIG. 6B. Accordingly, a contact portion 432*b*C of the primary coat layer 432C, that is exposed, contacts the electrode 370*c* or 370*d* directly. The contact portion 432*b*C is also exposed to the atmosphere. Consequently, nickel of the primary coat layer 432C may start corrosion (e.g., oxidation) at the contact portion 432*b*C.

Conversely, in the connector terminal 430 according to the first embodiment depicted in FIGS. 5A and 5B, the primary coat layer 432 includes the contact portion 432*b* and exposed portions 432*a*. The contact portion 432*b* contacts the electrode 370*c* or 370*d*. The exposed portions 432*a* are separated from the contact portion 432*b* and disposed at positions different from a position of the contact portion 432*b*. The exposed portions 432*a* are exposed to the atmosphere in advance before the surface layer 433 suffers from abrasion. Accordingly, corrosion (e.g., oxidation) progresses not only at the contact portion 432*b* but also at the exposed portions 432*a*. For example, the exposed portions 432*a* also consume corrosive gas (e.g., oxygen gas). As a result, an oxygen concentration in a periphery of the contact portion 432*b* is smaller than an oxygen concentration in a periphery of the contact portion 432*b*C of the connector terminal 430C as another comparative connector terminal depicted in FIG. 6B, suppressing progress of corrosion (e.g., oxidation) at the contact portion 432*b*.

As the exposed portions 432*a* are separated from the contact portion 432*b* farther, the oxygen concentration in the periphery of the contact portion 432*b* decreases more slowly. If abrasion of the surface layer 433 is small enough to retain the surface layer 433 at the contact portion 432*b*, as the exposed portions 432*a* increase, an area of the surface layer 433 other than the contact portion 432*b* decreases. Accordingly, corrosion of the surface layer 433 does not decrease easily. According to an experiment, if an area ratio of an area of the exposed portions 432*a* within a 6 mm square centering around the contact portion 432*b* is in a range of from 1% to 50%, the connector terminal 430 suppresses progress of corrosion (e.g., sulfidation) of the surface layer 433 and corrosion (e.g., oxidation) of the contact portion 432*b* effectively.

Table 1 below represents a relation between a type of metal, a type of gas, and corrosiveness. As table 1 indicates, silver is not oxidized easily but is subject to sulfidation. Conversely, nickel, copper, and stainless steel are not sulfurized easily but are subject to oxidation. Accordingly, if the contact portion 432*b* exposed to the atmosphere is made of nickel, the exposed portions 432*a* made of nickel are disposed in proximity to the contact portion 432*b*, for example, within the 6 mm square centering around the contact portion 432*b*. Additionally, an exposed portion made of coper or stainless steel is provided to suppress progress of corrosion (e.g., oxidation) of the contact portion 432*b*.

TABLE 1

| Type of metal | Type of gas | Corrosiveness |
|---|---|---|
| Silver (Ag) | Sulfur (S) | Great |
| | Oxygen (O) | Small |
| Nickel (Ni) | Sulfur (S) | Small |
| Copper (Cu) | Oxygen (O) | Great |
| Stainless steel (Fe) | | |

A description is provided of a construction of a connector terminal 430S according to a second embodiment of the present disclosure.

Figure 7B:
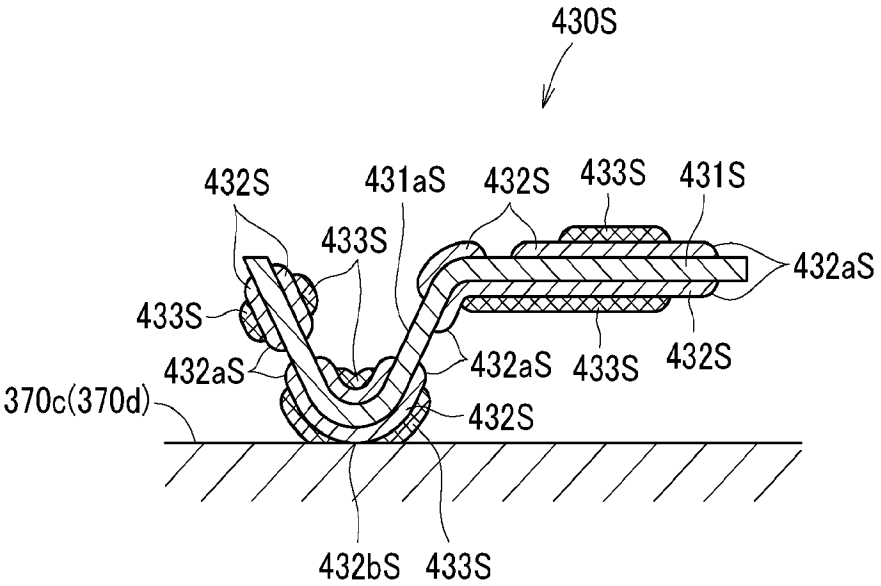
FIG. 7B is a cross-sectional view of the connector terminal depicted in FIG. 7A after the connector terminal suffers from abrasion.
Figure 7A:
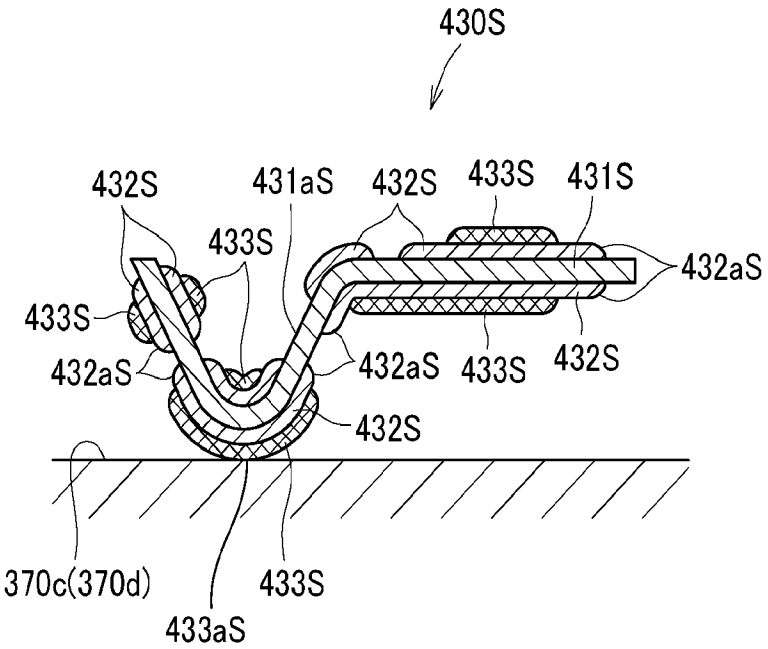
FIG. 7A is a cross-sectional view of a connector terminal according to a second embodiment of the present disclosure, that is installable in the heater depicted in FIG. 3A, before the connector terminal suffers from abrasion.

FIGS. 7A and 7B illustrate a cross section of the connector terminal 430S according to the second embodiment of the present disclosure, that is installable in the electrical connector 400. As illustrated in FIG. 7A, the connector terminal 430S contacts the electrode 370*c* or 370*d* at a contact portion 433*a*S before the connector terminal 430S suffers from abrasion. As illustrated in FIG. 7B, the connector terminal 430S contacts the electrode 370*c* or 370*d* at a contact portion 432*b*S after the connector terminal 430S suffers from abrasion. In the connector terminal 430S according to the second embodiment, not only a primary coat layer 432S made of nickel but also a base layer 431S made of copper is exposed.

For example, the primary coat layer 432S includes exposed portions 432*a*S. The base layer 431S also includes exposed portions 431*a*S. In other words, the primary coat layer 432S covers a part of a surface of the base layer 431S. A surface layer 433S covers a part of a surface of the primary coat layer 432S. The exposed portions 432*a*S and 431*a*S consume corrosive gas (e.g., oxygen gas). Accordingly, the connector terminal 430S increases an amount of consumption of corrosive gas (e.g., oxygen gas) and decreases an oxygen concentration in a periphery of the contact portion 432*b*S that contacts the electrode 370*c* or 370*d* further, thus suppressing progress of corrosion (e.g., oxidation) further. An area ratio of an area of the exposed portions 432*a*S or 431*a*S within a 6 mm square centering around the contact portion 432*b*S is preferably in a range of from 1% to 50% like the area ratio of the exposed portions 432*a* of the connector terminal 430 described above. A description is provided of a construction of a connector terminal 430T according to a third embodiment of the present disclosure.

Figure 8A:
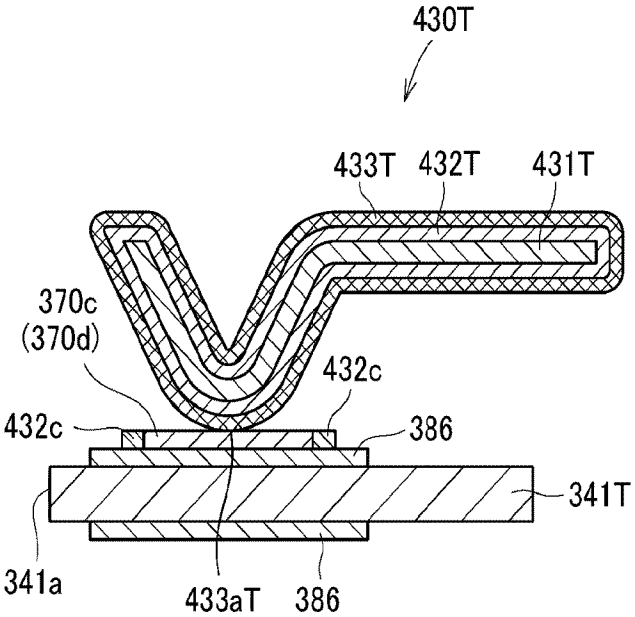
FIG. 8A is a cross-sectional view of a connector terminal according to a third embodiment of the present disclosure, that is installable in the heater depicted in FIG. 3A, before the connector terminal suffers from abrasion.
Figure 8B:
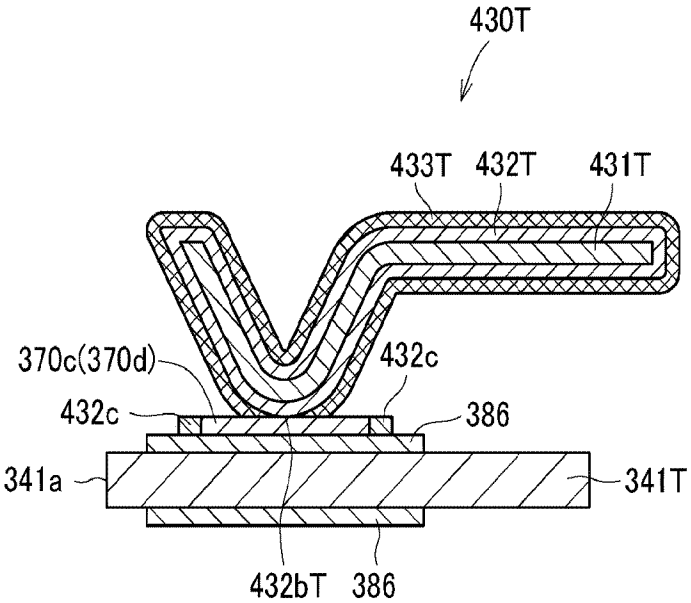
FIG. 8B is a cross-sectional view of the connector terminal depicted in FIG. 8A after the connector terminal suffers from abrasion.

As illustrated in FIG. 8A, the connector terminal 430T contacts the electrode 370*c* or 370*d* at a contact portion 433*a*T before the connector terminal 430T suffers from abrasion. As illustrated in FIG. 8B, the connector terminal 430T contacts the electrode 370*c* or 370*d* at a contact portion 432*b*T after the connector terminal 430T suffers from abrasion.

Figure 8C:
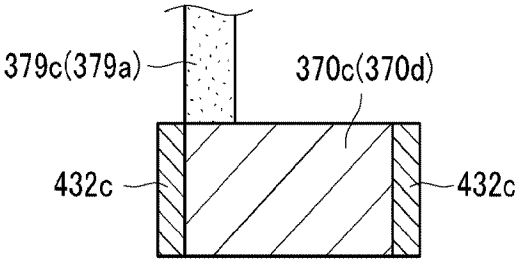
FIG. 8C is a plan view of an electrode that contacts the connector terminal depicted in FIG. 8B.

As illustrated in FIGS. 8A, 8B, and 8C, the connector terminal 430T according to the third embodiment includes a base layer 431T, a primary coat layer 432T, and a surface layer 433T. The connector terminal 430T further includes exposed portions 432*c* mounted on the electrode 370*c* or 370*c* that contacts the connector terminal 430T. The exposed portions 432*c* are made of a second conductive metal (e.g., nickel). As illustrated in FIG. 8C, the exposed portions 432*c* are mounted on both ends of each of the electrodes 370*c* and 370*d* in a short direction of a base 341T.

As the exposed portions 432*c* are disposed in proximity to the contact portion 432*b*T that contacts the electrode 370*c* or 370*d*, the exposed portions 432*c* also consume corrosive gas (e.g., oxygen gas) in addition to the contact portion 432*b*T. As a result, an oxygen concentration in a periphery of the contact portion 432*b*T decreases, suppressing progress of corrosion (e.g., oxidation) at the contact portion 432*b*T. An area ratio of an area of the exposed portions 432*c* within a 6 mm square centering around the contact portion 432*b*T is preferably in a range of from 1% to 50% like the area ratio of the exposed portions 432*a* of the connector terminal 430 described above.

As illustrated in FIGS. 8A and 8B, the base 341T is made of SUS and includes an exposure portion 341*a* disposed at a lateral end of the base 341T in a longitudinal direction thereof. The exposure portion 341*a* is exposed to the atmosphere. Corrosion (e.g., oxidation) of the exposure portion 341*a* also decreases a concentration of corrosive gas (e.g., an oxygen concentration) in the periphery of the contact portion 432*b*T. Accordingly, the exposure portion 341*a* also suppresses progress of corrosion of the contact portion 432*b*T like the exposed portions 432*a*, 431*a*S, 432*a*S, and 432*c*.

In the connector terminal 430 according to the first embodiment, the connector terminal 430S according to the second embodiment, and the connector terminal 430T according to the third embodiment described above, a type of metal used by the surface layers 433, 433S, and 433T of the connector terminals 430, 430S, and 430T, respectively, is preferably identical to a type of metal used by a surface layer of each of the electrodes 370*c* and 370*d*. If the type of metal used by the surface layers 433, 433S, and 433T is different from the type of metal used by the surface layer of each of the electrodes 370*c* and 370*d*, the different types of metal contact each other at an interface between each of the connector terminals 430, 430S, and 430T and the electrodes 370*c* and 370*d*, thus accelerating corrosion (e.g., corrosion due to contact between different types of metal) as an electrochemical reaction.

The surface layers 433, 433S, and 433T and the surface layer of each of the electrodes 370*c* and 370*d* are treated with metal plating with gold, silver, copper, platinum, nickel, tin, zinc, chromium, or the like. Silver plating is preferable in view of heat resistance and sliding. For example, the surface layers 433, 433S, and 433T of the connector terminals 430, 430S, and 430T, respectively, and the surface layer of each of the electrodes 370*c* and 370*d* are preferably treated with silver plating.

The above describes the embodiments of the present disclosure specifically. However, the technology of the present disclosure is not limited to the embodiments described above and is modified within the scope of the present disclosure. For example, the embodiments described above are applied to an electrical connector (e.g., the electrical connector 400) used for a heater (e.g., the laminated heater 330) installed in a fixing device (e.g., the fixing devices 300, 300S, 300T, and 300U). Alternatively, application of the embodiments of the present disclosure is not limited to the electrical connector used for the heater. For example, the embodiments of the present disclosure are applied to electrical connectors used for general electrical appliances such as switches and relays. The configurations of the surface layers 433, 433S, and 433T, the primary coat layers 432, 432S, and 432T, and the exposed portions 432*a* and 432*a*S may be applied to the electrodes 370*c* and 370*d* serving as the powered portions. The heater installed in the fixing device is not limited to the laminated heater 330 of a single type. For example, the heater installed in the fixing device may be a laminated heater in which a plurality of resistors is connected in parallel. The electrical connector 400 may also be used for the laminated heater in which the plurality of resistors is connected in parallel.

A description is provided of advantages of an electrical connector (e.g., the electrical connector 400).

As illustrated in FIGS. 4B, 5A, 5B, 7A, 7B, 8A, and 8B, the electrical connector includes a power feeding portion (e.g., the connector terminals 430, 430S, and 430T) and a powered portion (e.g., the electrodes 370*c* and 370*d*). The power feeding portion contacts the powered portion at a contact portion (e.g., the contact portions 433*a*, 433*a*S, 433*a*T, 432*b*, 432*b*S, and 432*b*T). At least one of the power feeding portion and the powered portion includes a surface layer (e.g., the surface layers 433, 433S, and 433T), a primary coat layer (e.g., the primary coat layers 432, 432S, and 432T), and an exposed portion (432*a*, 432*a*S, and 432*c*). The surface layer is made of a first conductive metal and includes the contact portion. The primary coat layer mounts the surface layer and is made of a second conductive metal. The exposed portion is separated from the contact portion and exposed to an atmosphere. For example, the exposed portion is disposed on the primary coat layer.

Accordingly, the electrical connector suppresses corrosion generated at the contact portion of the power feeding portion with a simple construction at reduced costs.

According to the embodiments described above, the fixing belt 310 serves as a fixing rotator. Alternatively, a fixing film, a fixing sleeve, or the like may be used as a fixing rotator. Further, the pressure roller 320 serves as a pressure rotator. Alternatively, a pressure belt or the like may be used as a pressure rotator.

According to the embodiments described above, the image forming apparatus 1 is a printer. Alternatively, the image forming apparatus 1 may be a copier, a facsimile machine, a multifunction peripheral (MFP) having at least two of printing, copying, facsimile, scanning, and plotter functions, an inkjet recording apparatus, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. An assembly comprising:

an electrical connector comprising a power feeding portion; and a powered portion configured to contact the power feeding portion, the power feeding portion including:

a surface layer being made of a first conductive metal and including a contact portion where the power feeding portion contacts the powered portion;

a primary coat layer being made of a second conductive metal, wherein the surface layer covers a part of the primary coat layer; and an exposed portion disposed on the primary coat layer, separated from the contact portion, and exposed to an atmosphere.

2. The assembly according to claim 1, wherein the exposed portion is made of the second conductive metal.

3. The assembly according to claim 1, wherein an area ratio of an area of the exposed portion within a 6 mm square centering around the contact portion is in a range of from 1% to 50%.

4. The assembly according to claim 1, wherein the at least one of the power feeding portion and the powered portion further includes a base layer made of a third conductive metal.

5. The assembly according to claim 4, wherein the primary coat layer covers a part of a surface of the base layer, and wherein the surface layer covers a part of a surface of the primary coat layer.

6. The assembly according to claim 4, wherein the power feeding portion includes the surface layer treated with silver plating, the primary coat layer treated with nickel plating, and the base layer made of copper.

7. The assembly according to claim 1, wherein each of the power feeding portion and the powered portion includes the surface layer made of the first conductive metal.

8. The assembly according to claim 1, wherein the power feeding portion includes a connector terminal.

9. The assembly according to claim 1, wherein the powered portion includes an electrode.

10. A heater comprising:

the assembly according to claim 1, and a resistor connected to the powered portion of the electrical connector, the resistor configured to generate heat by energization.

11. The heater according to claim 10, further comprising a base extending in a longitudinal direction of the base and being made of stainless steel.

12. The heater according to claim 11, wherein the base includes an exposure portion disposed at a lateral end of the base in the longitudinal direction of the base, the exposure portion exposed to the atmosphere, and wherein the assembly is connected to the exposure portion of the base.

13. A fixing device comprising:

the heater according to claim 10.

14. An image forming apparatus comprising the fixing device according to claim 13.

* * * * *